United States Patent [19]

Morita

[11] Patent Number: 4,833,893

[45] Date of Patent: May 30, 1989

[54] REFRIGERATING SYSTEM INCORPORATING A HEAT ACCUMULATOR AND METHOD OF OPERATING THE SAME

[75] Inventor: Keiichi Morita, Fujinomiya, Japan

[73] Assignee: Kabushiki Kaisha Toshiba, Kawasaki, Japan

[21] Appl. No.: 71,663

[22] Filed: Jul. 9, 1987

[30] Foreign Application Priority Data

Jul. 11, 1986 [JP] Japan ..... 61-163451
Jul. 11, 1986 [JP] Japan ..... 61-163452
Jul. 11, 1986 [JP] Japan ..... 61-163453

[51] Int. Cl.[4] ..... F25B 41/00; F25D 21/06

[52] U.S. Cl. ..... 62/713; 62/197; 62/238.6; 62/278

[58] Field of Search ..... 62/238.6, 238.1, 238.7, 62/278, 277, 513, 113, 197, 175, 196.2, 510, 186, 324.6, 160, 225; 165/902, 104.21; 237/2 B

[56] References Cited

U.S. PATENT DOCUMENTS 3,577,743 5/1971 Long ..... 62/225 X
3,838,582 10/1974 Redfern et al. ..... 62/196.4
4,102,151 7/1978 Kramer et al. ..... 62/278
4,314,456 2/1982 Harnish ..... 62/238.6 X
4,598,557 7/1986 Robinson et al. ..... 62/238.6

FOREIGN PATENT DOCUMENTS 49-20023 5/1974 Japan .

*Primary Examiner*—Harry B. Tanner
*Attorney, Agent, or Firm*—Foley, Lardner, Schwartz, Jeffery, Schwaab, Mack, Blumenthal & Evans

[57] ABSTRACT

A refrigerating system comprising a compressor, a condenser communicated with the discharge port of the compressor, an evaporator communicated with the suction port of the compressor, a decompression or expansion device inserted in a line intercommunicating the condenser and the evaporator, a heat accumulator interposed between the discharge port of the compressor and the condenser and a bypass line whose one end is communicated with a line intercommunicating the compressor and the decompression device and whose other end is communicated through the heat accumulator to a line intercommunicating the decompression device and the evaporator.

17 Claims, 4 Drawing Sheets

REFRIGERATING SYSTEM INCORPORATING A HEAT ACCUMULATOR AND METHOD OF OPERATING THE SAME

BACKGROUND OF THE INVENTION

The present invention relates to a refrigerating system and more particularly a refrigerating system incorporating a heat accumulator.

It has been well known to those skilled in the art that a refrigerating system incorporates a heat accumulator so that, for instance, in the case of the refrigerating mode, a refrigerant which has been heated to a high temperature and compressed to a high pressure by a compressor is introduced into and stored in the heat accumulator. When frost and ice accumulate over the surfaces of an evaporator, the accumulated heat is utilized to melt them in the defrosting mode, thereby improving the capacity of the refrigerating system (Japanese Patent Application Publication No. 20023/1974).

In a refrigerating system of the type described above, in which its capacity is improved by temporarily utilizing the heat accumulated in the heat accumulator, the heat accumulated in the heat accumulator is utilized for improving the defrosting, but there is a problem in that the accumulated heat is not utilized at all in the initial operation of a heat exchanger (condenser on the side of the refrigerating cycle where utilization of the accumulated heat is most desired.

Furthermore, there is another problem in that the pressure in the line interconnecting the heat accumulator and the compressor rises during the heat accumulation mode so that a bypass line between a check valve and a line branching point becomes a liquid sump.

SUMMARY OF THE INVENTION

A primary object of the present invention is to provide a refrigerating system which can effectively utilize the heat accumulated in a heat accumulator in the initial operational stage of a heat exchanger (condenser) and also can eliminate liquid accumulation in the various lines.

Another object of the present invention is to provide a refrigerating system which can attain a high degree of heating capacity and also can accomplish defrosting operation by utilizing the heat accumulated in the heat accumulator in the defrosting mode.

To the above and other ends, the present invention provides a refrigerating system comprising a compressor, a condenser communicated to the discharge port of the compressor, an evaporator communicating with the suction port of the compressor, a decompression device inserted into a line intercommunicating the condenser and the evaporator, a heat accumulator interposed between the discharge port of the compressor and the condenser and a bypass line whose one end is connected to a point between the condenser and the decompression device and whose other end is connected to a point between the decompression device and the evaporator through the heat accumulator.

Furthermore, the present invention provides a refrigerating system comprising means for detecting the temperature of the heat accumulated in the heat accumulator which is disposed therein, an evaporating fan mounted on the evaporator and control means for controlling the operation of the evaporating fan in response to a detected value derived from the temperature detection means.

The present invention also provides a refrigerating system in which a branch pipe is extended from the outlet port of the heat accumulator of the bypass line and is communicated with the suction port of the compressor.

Moreover the present invention provides a refrigerating system in which a branch pipe is extended from the outlet port of the heat accumulator of the bypass line and is communicated with the compression chamber of the compressor.

According to the present invention, a refrigerant which has been heated to a high temperature and compressed to a high pressure by the compressor is accumulated in the heat accumulator by the heat exchange, and in the initial operation of the heat exchanger (condenser) on the side of the utilization of the cooling cycle, the refrigerant which has been liquefied through the condenser is introduced through the bypass line into the heat accumulator in which the heat exchange between the liquefied refrigerant and the high temperature refrigerant is carried out so that the evaporation temperature of the refrigerant becomes high and consequently a high output per unit time can be obtained in the case of the initial operation stage of the heat exchanger (condenser) on the side of the utilization of the cooling cycle.

According to the present invention, the bypass line is connected to the lower pressure side between the evaporator and the decompression device so that the accumulation of the liquid refrigerant in the bypass line can be eliminated.

Furthermore according to the present invention, the ON-OFF control of the evaporating fan can be controlled at a predetermined accumulated heat temperature so that the heat radiation loss can be prevented in the case of the operation utilizing the accumulated heat.

According to the present invention, the branch pipe is extended from the bypass line at the output port of the heat accumulator and is communicated to the suction port of the compressor so that in the case of the operation utilizing the accumulated heat, the refrigerant can be returned directly to the compressor after the heat exchange through the heat accumulator of the refrigerant from the condenser, whereby the heat radiation loss of the evaporator can be prevented and the pressure loss in the evaporator can be avoided. Moreover, in the case of the defrosting mode, the refrigerant can be introduced into the evaporator after the heat exchange through the heat accumulator of the refrigerant from the condenser so that the defrosting operation can be carried out during the heating cycle and consequently continuous heating can be carried out.

According to the present invention, in the initial operation stage of the heat exchanger (condenser) on the side of the utilization of the refrigerating system, when the temperature of heat accumulated in the heat accumulator is at a high level, the refrigerant discharged from the condenser is introduced into the heat accumulator and after the heat exchange at a high degree of efficiency is carried out in the heat accumulator, the refrigerant is returned to the compression mechanism in the compressor, but when the temperature of heat accumulated in the heat accumulator is at a low level, the refrigerant is delivered to the evaporator after the heat exchange in the accumulator so that the heat exchange for absorbing heat can be carried out and consequently the range of the temperature of the heat accumulator which can be utilized can be expanded.

DESCRIPTION OF THE PREFERRED EMBODIMENTS

Figure 1:
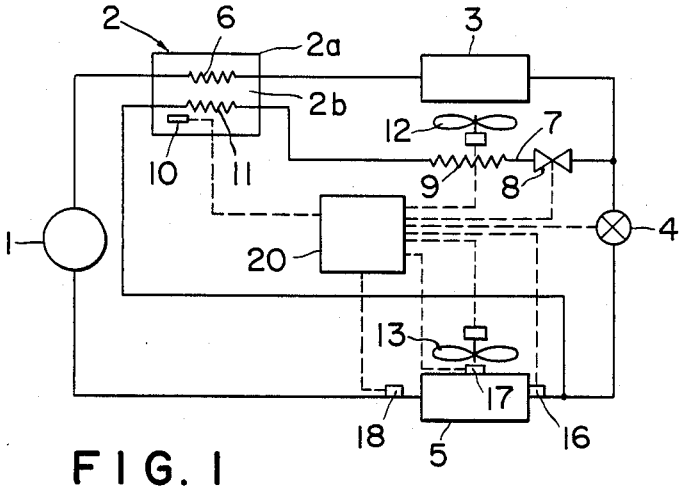
FIG. 1 is a schematic diagram of a preferred embodiment of the refrigerating system in accordance with the present invention.

FIG. 1 shows a refrigerating system applied to an air conditioning system and having a compressor 1, a heat accumulator 2, a heat exchanger (condenser) 3, such as a heat exchanger installed in a room, a first decompression or expansion device 4, and a heat exchanger (evaporator) 5 such as a heat exchanger installed outside of the room.

The heat accumulator 2 is packed with a heat accumulating material 2*b* and, in this first example, a heat accumulator chamber 2*a* is packed with paraffin 115 (with a melting point of 45° C.). The heat accumulator 2 receives the heat of a refrigerant which has been heated to a high temperature and a high pressure when compressed by the compressor 1 to accumulate this heat. It can accumulate heat at high temperatures in the refrigerating system.

A bypass line 7 intercommunicates the room heat exchanger 3 and the outside heat exchanger 5 (installed outside of a room), and one end of the bypass line 7 is connected to a line interconnecting the room heat exchanger 3 and the decompression device 4, while the other end thereof is connected through the heat accumulator 2 to a line interconnecting the decompression device 4 and the outdoor heat exchanger 5. The bypass line 7 includes a valve 8, a second decompression or expansion device 9 and a refrigerant line 11.

The room heat exchanger 3 has an indoor fan 12 (condensing fan) while the outdoor heat exchanger 5 has an outdoor fan 13 (for the evaporator). The heat accumulator 2 is provided with a temperature sensor 10 (such as a thermistor or the like) for detecting the temperature inside the heat accumulator 2. In response to the output from the temperature sensor 10, the outdoor fan 13 is turned on or off.

Next the mode of the refrigerating system of the air conditioning system of the above-described organization in accordance with the present invention will be described.

First referring to a table illustrating the conditions of the indoor fan 12, the outdoor fan 13, the valve 8 and the decompression device 4 in each mode, their operations will be described.

| Operation selection switch | Operation mode | Indoor fan 12 | Outdoor fan 13 | Valve 8 | Decompression device 4 |
|---|---|---|---|---|---|
| (1) Heat accumulation operation | heat accumulation | Off | On | Closed | Superheat control |
| (2) Normal operation | 1 heating by utilizing accumulated heat | On | Off or On | Opened | Closed |
| | 2 heating and heat accumulation | On | On | Closed | Superheat control |
| | 3 defrosting | On | Off | Opened | Closed |

The valve 8, the decompression device 4 and the indoor and outdoor fans 12 and 13 are controlled as shown in the TABLE. The operation actuates an operation selection switch (not shown) to select the heat accumulation operation or the normal operation. The decompression device 4 may be an automatic temperature expansion valve, but it is preferable to use an electric-motor-driven type expansion valve disclosed in Japanese Laid-Open Patent Application No. 59-170653. The decompression device 4 can accomplish a so-called superheat control in response to the outputs from the temperature sensors 17 and 18 in such a way that the difference between the evaporation temperature and the suction temperature of the compressor 1 can be maintained at a constant predetermined value.

(1) Heat-Accumulation Operation:

The operator switches the operation selection switch (not shown) to the heat-accumulation operation mode. Then the refrigerant compressed by the compressor 1 flows through the heat accumulator 2, the indoor heat exchanger 3, the decompression device and the outdoor heat exchanger 5 back to the compressor 1. During the circulation of the refrigerant, heat is accumulated in the heat accumulator 2. In the case of the first preferred embodiment of the invention, when the temperature of heat accumulated in the heat accumulator and detected by the temperature sensor 10 is lower than 50° C., the compressor 1 is turned on, while when the detected temperature exceeds 55° C., the compressor 1 is turned off.

(2) Normal Operation:

When the operator switches the operation selection switch (not shown) to the normal operation mode, the mode of heating utilizing the accumulated heat or the heating and heat-accumulation mode is automatically selected in response to the temperature within the heat accumulator vessel 2*a*.

In the first preferred embodiment of the invention, when the temperature inside the heat accumulator vessel 2*a* is in excess of 10° C., "the mode of heating utilizing accumulated heat" in which a high degree of heating capacity is obtained by utilizing the quantity of heat stored in the heat accumulating material 2*b* is started. On the other hand, when the temperature of the heat accumulator vessel 2*a* is lower than 10° C., the air conditioning system cannot be switched into the mode of intense heating by utilizing heat accumulated in the heat accumulator 2, so that it is switched into "the heating and heat-accumulation mode".

First the mode of heating by utilizing accumulated heat will be described.

(2)- 1 The mode of heating by utilizing accumulated heat (the initial stage of heating) outdoor fan 13 is ON-OFF controlled in response to the temperature in the heat accumulator vessel 2*a* detected by the temperature sensor 10 so that the heat dissipation from the outdoor heat exchanger 5 due to the forced convection is prevented, and only the dissipation of heat due to natural convection is permitted, whereby the heat dissipation is reduced to a minimum.

Figure 2:
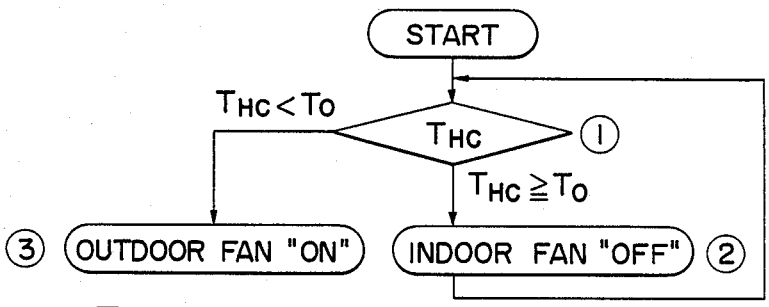
FIG. 2 is a flowchart indicating the method of controlling the refrigerating system.

More particularly, in FIG. 2, the temperature of the heat accumulator detected by the temperature sensor 10 is represented by $T_{HC}$, and an initial set point temperature at which the outdoor heat exchanger 5 starts dissipating heat is represented by To, which is set at 15° C. in the first preferred embodiment of the invention. When the operation is started, the comparison between $T_{HC}$ and To is made (step 1 ), and when $T_{HC} \geqq$ To, the outdoor fan 13 is turned off (step 2 ), but when $T_{HC} <$ To, the outdoor fan 13 is turned on (step 3 ).

The switching between the mode of heating by utilizing accumulated heat and the heating and heat-accumulation mode is made in response to the result of the comparison between the temperature $T_{HC}$ and the set point Tp as shown in the TABLE shown below.

When no heating operation is needed, heat is accumulated in the heat accumulator 2 so that in the initial stage of heating, heating is carried out at once by the high output from the heat accumulator. That is, the refrigerant compressed by the compressor 1 flows through the heat accumulator 2 into the indoor heat exchanger in which heat exchange is carried out. The refrigerant which is liquefied by the indoor heat exchanger flows through the valve 8 and the decompression device 9 into the heat accumulator 2 in which heat exchange is carried out. The refrigerant heated by the heat accumulator 2 returns through the outdoor heat exchanger 5 to the compressor 1. In this case, the temperature of the heat accumulating material 2*b* is high so that the refrigerant is evaporated. Then the evaporation temperature of the refrigerant becomes high so that the suction pressure of the compressor 1 is increased. As a result, the quantity of circulating refrigerant is increased so that heating is accomplished at once by the high output heat discharged from the indoor heat exchanger 4. In this case, when the temperature of the refrigerant discharged from the heat accumulator 2 is higher than the temperature around the outdoor heat exchanger 5, the latter does not absorb heat from the surrounding air, but dissipates heat to the surrounding atmosphere so that there arises a problem in that the heating capacity is decreased. Therefore, the

| | Temperature of the heat accumulator | |
|---|---|---|
| | Higher than Tp | Lower than Tp |
| mode | mode for utilizing accumulated heat | heating and heat accumulation |

In this case, Tp is set at 10° C. When the heating mode by utilizing accumulated heat continues, the temperature of the heat accumulator vessel 2*a* drops and when it drops below, for instance, Tp, the air conditioning system is automatically switched to the "heating and heat-accumulation mode" ((2)- 2 ) to be described below.

(2)- 2 Heating and Heat-Accumulation Mode:

In the heating and heat-accumulation mode in which heating is continued while heat is accumulated, the refrigerant compressed by the compressor 1 is circulated through a loop consisting of the heat accumulator 2, the indoor heat exchanger 3, the decompression device 4, the outdoor heat exchanger 5 and the compressor 1. When the heating operation is continued in this manner, frost is formed on the outdoor heat exchanger 5 when the atmospheric temperature is low, so that the defrosting operation is needed.

The switching between "the heat accumulation mode" and "the heating and heat-accumulation mode" can be made automatically in response to the result of the comparison between the room temperature $T_{IN}$ and a set point Ts of an indoor thermostat as shown in the TABLE below.

| Condition | $T_{IN} \geqq$ Ts | $T_{IN} <$ Ts |
|---|---|---|
| mode | heat accumulation | heating and heat accumulation |

In this case, the air conditioning equipment is switched into the heat accumulation mode described above (1), but when Ts becomes higher than $T_{IN}$ ($Ts > T_{IN}$) during the heat accumulation mode, the air conditioning equipment is switched into the heating and heat-accumulation mode. In this case, in order to accelerate the initial stage of the operation, the air conditioning equipment can be switched into the heat accumulation mode when the temperature of the heat accumulator vessel 2*a* is higher than 10° C.

Next the defrosting mode will be described.

(2)- 3 Defrosting Mode:

In the case of the mode for defrosting the outdoor heat exchanger, the defrosting operation is started when the temperature becomes lower than a set point (for instance, at 15° C.) of a temperature sensor 16 disposed at the heating inlet port of the outdoor heat exchanger 5. Another condition for starting the defrosting operation is that a predetermined time interval (for instance, 40 minutes) has elapsed after the preceding defrosting operation. When the temperature detected by the temperature sensor 16 becomes higher than its set point (for instance, 10° C.), the defrosting operation is interrupted and then the air conditioning equipment is switched to the heating and heat-accumulation mode.

In the defrosting mode, the valve 8 is opened so that the refrigerant line becomes the same as that in the mode of heating by utilizing accumulated heat; that is, a loop consisting of the compressor 1, the heat accumulator 2, the indoor heat exchanger 3, the valve 8, the decompression device 9, the outdoor heat exchanger 5 and the compressor 1 so that heat accumulated in the heat accumulator 2 can be effectively utilized. In the defrosting mode, the defrosting operation can be carried out while heating is continued.

Figure 3:
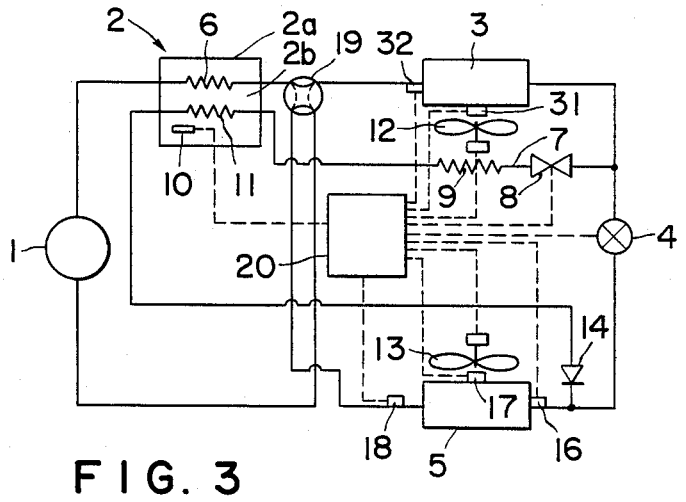
FIG. 3 is a schematic diagram of another preferred embodiment of the refrigerating system in accordance with the present invention in which is incorporated a fourport connection valve.

In the first preferred embodiment of the invention, the refrigerating system of the air conditioning equipment exclusively used for heating has been described, but it is to be understood that the present invention may be equally applied to the refrigerating system of a heat pump type air conditioning equipment capable of both heating and refrigerating as shown in FIG. 3.

More particularly, it becomes possible to provide a refrigerating system by disposing temperature sensors 31 and 32 adjacent to the indoor heat exchanger 3, inserting a check valve 14 in the bypass line 7 and interposing a four-port connection valve 19 between the heat accumulator 2 and the indoor heat exchanger 3. In the example shown in FIG. 3, the modes except "the refrigerating mode" are substantially similar to those of the first example described above so that only the "refrigerating mode" will be described below.

| Mode | Indoor fan 12 | Outdoor fan 13 | Valve 8 | Decompression device 4 |
|---|---|---|---|---|
| Refrigeration | On | On | Closed | superheat control |

In the refrigerating mode, the refrigerant compressed by the compressor 1 is circulated through a loop consisting of the heat accumulator 2, the four-port connection valve, 19, the outdoor heat exchanger, the decompression device 4, the indoor heat exchanger 3 and the compressor 1. Even in the refrigeration mode, heat is accumulated in the heat accumulator 2. So far the valve 8 has been described as being closed, but it is to be understood that it may be opened to return the refrigerant in the bypass line 7.

Figure 4A:
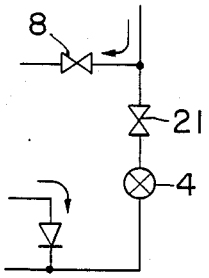
FIGS. 4(*a*) and 4(*b*) are partial piping diagrams showing modifications of the decompression device in the refrigerating system.
Figure 4B:
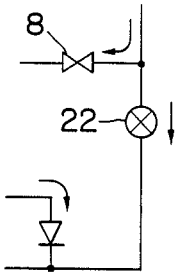

In the examples described above with reference to FIGS. 1 and 3, the decompression device 4 is an electric-motor-driven expansion valve disclosed in detail in the Japanese Laid-Open Patent Application No. 59-170653, but it is to be understood that when a temperature responsive expansion valve is used as the decompression device 4 and when a valve 21 is inserted as shown in FIG. 4(*a*), the flow of the refrigerant into the decompression device 4 can be completely interrupted. More particularly, as shown in FIG. 4(*a*), the valve 21 is inserted on the upstream side of the decompression device 4, and when the valve 8 is opened the valve 21 is closed. It is preferable that the flow of the refrigerant into the decompression device 4 be completely shut out, but, as shown in FIG. 4(*b*), the valve can be eliminated so that a portion of the refrigerant may be permitted to flow through a decompression device 22.

Figure 5:
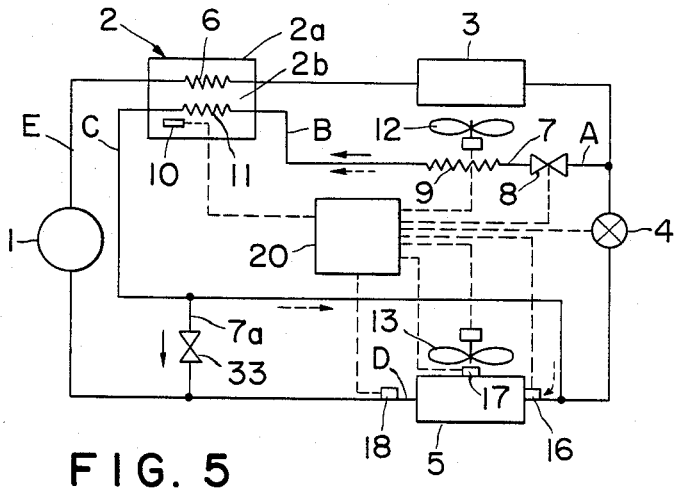
FIG. 5 is a schematic diagram of a third preferred embodiment of the refrigerating system in accordance with the present invention.

FIG. 5 shows a second preferred embodiment of the refrigerating system in accordance with the present invention. In FIG. 5 the same reference numerals are used to designate parts which are similar to corresponding parts in FIGS. 1 through 5.

In this example, the bypass line 7 extending between the indoor heat exchanger 3 and the outdoor heat exchanger 5 is further branched to a branch pipe 7*a* after the bypass line 7 is extended through and beyond the heat accumulator 2, and the branch pipe 7*a* with a valve 33 is connected to the suction port of the compressor 1.

Next the mode of operation of this example of the above-described organization will be described.

As in the cases of the examples described hereinabove, each operation will be described on the basis of the following TABLE showing the conditions or states of the indoor fan 12, the outdoor fan 13, the valves 8 and 33 and the decompression device 4 in each mode.

| Operation selection switch | Operation mode | Indoor fan 12 | Outdoor fan 13 | Valve 8 | Valve 33 | Decompression device 4 |
|---|---|---|---|---|---|---|
| (1) Heat accumulation operation | heat accumulation | Off | On | Closed | Closed | Superheat control |
| (2) Normal operation | 1 heating by utilizing accumulated heat | On | On or Off | Closed | Closed or Opened | Closed or superheat control |
| | 2 heating and heat accumulation | On | On | Closed | Closed | Superheat control |
| | 3 defrosting | On | Off | Opened | Opened | Closed |

(1) Heat-Accumulation Operation:

The operator switches an operation selection switch (not shown) to the heat-accumulation operation so that the air conditioning equipment is switched into the "heat-accumulation mode". Then the refrigerant compressed by the compressor 1 is circulated through a loop consisting of the heat accumulator 2, the indoor heat exchanger 3, the decompression device 4, the outdoor heat exchanger 5 and the compressor 1 so that heat is accumulated in the heat accumulator 2. In this example, when the temperature sensed by the temperature sensor 10 becomes lower than 50° C., the compressor 1 is turned on, but when the temperature rises in excess of 55° C., the compressor 1 is turned off.

(2) Normal Operation:

When the operator switches the operation selection switch (not shown) to the normal operation, the mode for heating utilizing accumulated heat or the heating and heat-accumulation mode is automatically selected in response to the temperature in the heat accumulator vessel 2*a*.

In this example, when the temperature in the heat accumulator vessel 2*a* is higher than, for instance, 10° C., "the mode for heating utilizing accumulated heat mode" which can produce high heating capacity by utilizing the heat quantity accumulated in the heat accumulating material 2*b* is started. On the other hand, when the temperature in the heat accumulator vessel 2*a* is lower than 10° C., high heating capacity operation through utilization of accumulated heat cannot be carried out so that the air conditioning equipment is switched into "the heating and heat-accumulation mode".

First the mode of heating by utilizing accumulated heat will be described.

(2)- 1 Mode for Heating by Utilizing Accumulated Heat (the initial heating stage):

In this mode, heat accumulated in the heat accumulator 2 when heating is not needed is utilized to heat at once with a great output when the heating operation is initiated. As shown in the above TABLE, the valve 8 and the valve 33 are opened, and in general the decompression device is closed while the outdoor fan 13 is turned off. Then the refrigerating cycle is carried out as indicated by the solid line arrows in FIG. 5. The refrigerant compressed by the compressor 1 flows through the heat accumulator 2 into the indoor heat exchanger 3 in which the heat exchange is accomplished. The liquefied refrigerant discharged from the indoor heat exchanger 3 flows through the valve 8 and the decompression device 9 into the heat accumulator 2 in which the heat exchange is carried out. The refrigerant heated in the heat accumulator 2 flows through the branched pipe *7a* and the valve 33 back to the compressor 1. In this case, since the temperature of the heat accumulating material *2b* is high, the refrigerant is evaporated, and since the evaporation temperature of the refrigerant becomes high, the suction pressure of the compressor 1 is increased, and heating of a room can be accomplished at once by the high heat output discharged from the indoor heat exchanger 3.

In this example, the branch pipe *7a* is branched from the bypass line 7 intercommunicating the indoor heat exchanger 3 and the outdoor heat exchanger 5 and is connected to the suction port of the compressor 1 so that in the case of the mode of heating by utilizing accumulated heat in the initial heating stage, heat radiation loss of the outdoor heat exchanger 5 can be prevented, and furthermore the pressure loss can also be avoided.

In the example described above, the decompression device 4 is closed, but it is to be understood that the superheat control of the decompression device 4 can be carried out so that a portion of the refrigerant will flow through the outdoor heat exchanger 5 (while the outdoor fan is turned on) so as to absorb heat from the surrounding atmosphere. Furthermore, in the initial heating stage, the valve 33 is normally opened, but it is to be understood that the valve 33 can be opened or closed in response to the temperature detected by the temperature sensor 10 disposed in the heat accumulator 2. More particularly, when this temperature is lower than 15° C., the valve 33 is closed so that the refrigerant is so controlled as to flow into the outdoor heat exchanger 5.

Figure 6:
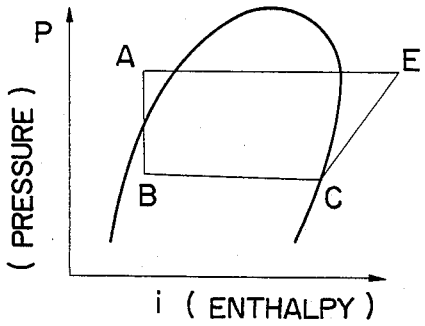
FIG. 6 is a Mollier diagram in the case of the heating mode utilizing heat accumulated during the cooling cycle.

The mode of operation will be described with reference to FIG. 2 as in the cases of the aforedescribed examples. The temperature detected by the temperature sensor 10 is denoted by $T_{HC}$ and the heating starting temperature of the outdoor heat exchanger 5 is designated by an initially set point To, which is, for instance, 15° C. Upon starting of the operation, $T_{HC}$ is compared with To (Step 1 ) and when $T_{HC} \geqq To$, the valve 33 is opened (step 2 ), but when $T_{HC} < To$, the valve 33 is closed (step 3 ). In this case, the outdoor fan 13 is so controlled as to be turned off when the valve 33 is opened and to be turned on when the valve 33 is closed. (When the superheat control is carried out by causing the refrigerant to flow into the decompression device 4, the outdoor fan 13 is turned on.) FIG. 6 shows a Mollier diagram for the case of the abovementioned initial heating stage. A, B, C, and E in FIG. 6 correspond to A, B, C and E in FIG. 5. The switching between the heating mode by utilizing accumulated heat and the heating and heat-accumulation mode is made in response to the result of the comparison of the temperature ($T_{HC}$) with the set point To which is 10° C. in this example as shown in the TABLE below.

| | Temperature of the heat accumulator | |
|---|---|---|
| | Higher than Tp | Lower than Tp |
| Mode | Heating mode by utilizing accumulated heat | Heating and heat-accumulation mode |

When the mode of heating by utilizing accumulated heat is continued, the temperature of the heat accumulator vessel *2a* drops and when it drops below Tp, the air conditioning equipment is switched to "the heating and heat-accumulation mode" described below.

(2)- 2 Heating and Heat-Accumulation Mode:

In the case of the heating and heat-accumulation mode in which, while heating is continued, heat is accumulated, the refrigerant compressed by the compressor 1 is circulated through a loop consisting of the heat accumulator, the indoor heat exchanger 3, the decompression device 4, the outdoor heat exchanger 5 and the compressor 1. When the heating operation is continued in the manner described above, frost is formed on the outdoor heat exchanger 5 when the environmental temperature is low so that the defrosting operation must be carried out.

The switching between the "heat-accumulation mode" and the "heating and heat-accumulation mode" can be automatically made in response to the result of the comparison of the room temperature ($T_{IN}$) with a set point (Ts) of an indoor thermostat as shown in the TABLE below.

| Conditions | $T_{IN} \geqq Ts$ | $T_{IN} < Ts$ |
|---|---|---|
| mode | heat accumulation | heating and heat accumulation |

In this case, the air conditioning equipment is switched into the heat accumulation operation (1) described above, but is switched into the heating and heat-accumulation mode when Ts becomes higher than $T_{IN}$ during the heat accumulation mode. In order to accelerate the initial operation stage, the air conditioning equipment can be switched to the mode of heating by utilizing accumulated heat when the temperature of the heat accumulator vessel *2a* is higher than 10° C.

Next the defrosting operation mode will be described.

(2)- 3 Defrosting Mode:

In the case of the mode of defrosting the outdoor heat exchanger, the defrosting operation is started when the temperature detected by the temperature sensor 16 disposed on the heating inlet of the outdoor heat exchanger 5 drops below a predetermined level (for instance, −15° C.). Another condition for permitting the defrosting operation is that a predetermined time interval (for instance, 40 minutes) has elapsed after the preceding defrosting operation. When temperature detected by the temperature sensor 16 rises above a predetermined level (for instance, 10° C.), the defrosting operation is stopped and then the above-mentioned heating and heat-accumulation mode is started.

Figure 7:
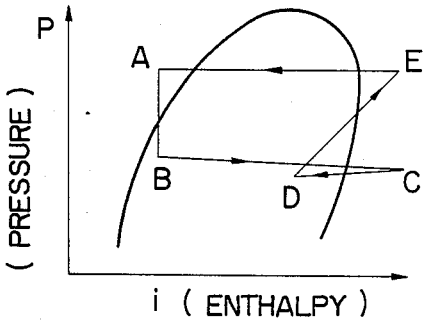
FIG. 7 is a Mollier diagram in the case of the defrosting mode in the refrigerating system.

In the case of the defrosting mode, the refrigerant circulates, as indicated by the dotted line arrows in FIG. 5, through a loop consisting of the compressor 1, the heat accumulator 2, the indoor heat exchanger 3, the valve 8, the decompression device 9, the outdoor heat exchanger 5 and the compressor 1 because the valve 8 is opened, whereby the heat accumulated in the heat accumulator 2 can be effectively utilized to defrost the outdoor heat exchanger 5. Even in the case of the defrosting mode, while heating is continued, defrosting can be accomplished. A, B, C, D and E in FIG. 7 correspond to A, B, C, D and E, respectively, in FIG. 5.

Figure 8:
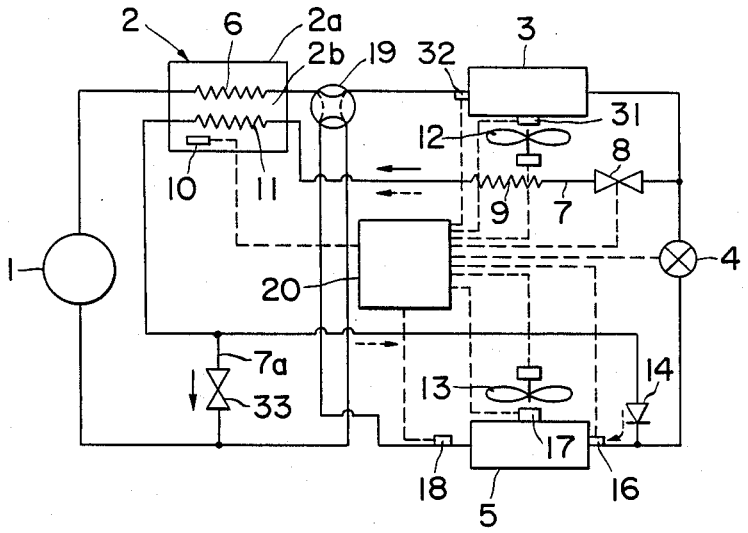
FIG. 8 is a schematic diagram similar to the refrigerating system shown in FIG. 5 but incorporating a four-port connection valve.

In the example shown in FIG. 5, the refrigerating system of the air conditioning equipment is used exclusively for heating, but it is to be understood that the present invention can be applied equally to a heat-pump type air conditioning equipment used for both heating and refrigerating as shown in FIG. 8.

More particularly, as in the case of the example shown in FIG. 3, temperature sensors 31 and 32 are disposed adjacent to the indoor heat exchangerr 3; the check valve 14 is inserted into the bypass line 7; and the four-port connection valve 19 is interposed between the heat accumulator 2 and the indoor heat exchanger 3, whereby the refrigerating cycle becomes possible. In the example shown in FIG. 8, various operation modes except the refrigerating or cooling mode are substantially similar to those of the preceding examples, so that only the refrigerating or cooling mode will be described.

| Mode | Indoor fan 12 | Outdoor fan 13 | Valve 8 | Valve 33 | Decompression device 4 |
|---|---|---|---|---|---|
| Refrigeration | On | On | Closed | Opened | Superheat control |

In the refrigeration or cooling mode, the refrigerant compressed by the compressor 1 circulates through a loop consisting of the heat accumulator, the four port connection valve 19, the outdoor heat exchanger 5, the decompression device 4, the indoor heat exchanger 3 and the compressor 1. Even in the refrigeration or cooling mode, the heat accumulator 2 accumulates heat. The valves 8 and 33 have been described as being closed, but at least one of the valves 8 and 33 is opened to return the refrigerant in the bypass pipe 7.

In the examples described above with reference to FIGS. 5 and 8, the decompression device 4 may be an automatic temperature responsive expansion valve arranged as shown in FIG. 4(*a*) as in the other examples. Furthermore, the valve can be eliminated so that a portion of the refrigerant is caused to flow through the decompression device 22 as shown in FIG. 4(*b*).

Figure 9:
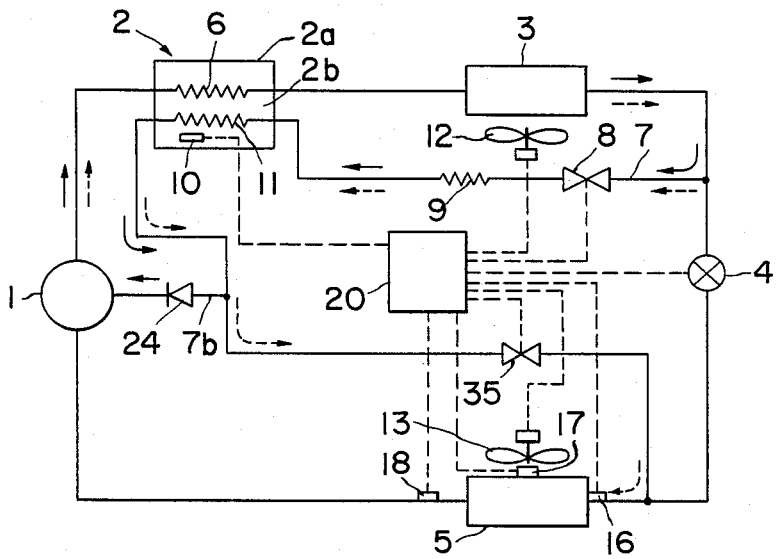
FIG. 9 is a schematic diagram of a fourth preferred embodiment of the refrigerating system in accordance with the present invention.

FIG. 9 shows a diagram of a third preferred embodiment of the refrigerating system in accordance with the present invention. In FIG. 9 the same reference numerals are used to designate parts similar to corresponding parts in FIGS. 1 through 9.

In this example, in addition to the valve 8, the decompression device 9 and a refrigerant pipe 11, a valve 35 is inserted into the bypass line 7 extending between the indoor heat exchanger 3 and the outdoor heat exchanger 8. Furthermore the bypass line 7 extending out of the heat accumulator 2 is branched; that is, it has a branch or injection pipe 7*b* connected to the cylinder of the compression mechanism of the compressor 1. A check valve 24 is inserted into the injection pipe 7*b*.

Next the mode of operation of the example of the above described organization will be described.

First, as in the cases of the preceding examples, each operation will be described with reference to a TABLE showing the conditions or states of the indoor fan 12, the outdoor fan 13, the valves 8 and 35 and the decompression device 4 in each mode.

| Operation selection switch | Operation mode | Indoor fan 12 | Outdoor fan 13 | Valve 8 | Valve 35 | Decompression device 4 |
|---|---|---|---|---|---|---|
| (1) Heat accumulation operation | heat accumulation | Off | On | Closed | Closed | Superheat control |
| (2) Normal operation | 1 heating by utilizing accumulated heat | On | Off or On | Opened | Closed or Opened | Closed or superheat control |
| | 2 heating and heat accumulation | On | On | Closed | Closed | Superheat control |
| | 3 defrosting | On | Off | Opened | Opened | Closed |

(1) Heat-Accumulation Mode:

When the operator switches the operation selection switch (not shown) to the heat-accumulation operation, the air conditioning equipment is switched to the "heat-accumulation mode". Therefore, the refrigerant compressed by the compressor 1 is circulated through a loop consisting of the heat accumulator 2, the indoor heat exchanger 3, the decompression device 4, the outdoor heat exchanger 5 and the compressor 1. During such circulation of the refrigerant, the heat accumulator accumulates heat, and in this example the compressor 1 is controlled in such a way that when the temperature detected by the temperature sensor 15 drops below 50° C., the compressor 1 is turned on, but when the temperature rises in excess of 55° C., the compressor is turned off.

(2) Normal Operation:

When the operator switches the operation selection switch (not shown) to the normal operation, the mode for heating by utilizing accumulated heat or the heating and heat-accumulation mode is automatically selected in response to the temperature in the heat accumulator vessel 2*a*.

In this example, when the temperature in the heat accumulator vessel 2*a* is higher than 10° C., "the mode for heating by utilizing accumulated heat" is started by utilizing the heat quantity stored in the heat accumulating material 2*b* so that a high heating capacity can be obtained. On the other hand, when the temperature of the heat accumulator vessel 2*a* is below 10° C., intense heating by utilizing accumulated heat cannot be carried out so that the air conditioning equipment is switched into "the heating and heat-accumulation mode".

First, the heating operation by utilizing accumulated heat will be described.

(2)-○1 Mode for Heating by Utilizing Accumulated Heat (Initial Heating Stage):

This is the mode in which in the case of starting heating, the heating of a room can be accomplished at once with a high output by utilizing heat accumulated in the heat accumulator 2 during the time when no heating is carried out.

In this mode, as indicated in the above TABLE, the decompression device 4 is generally closed; the outdoor fan 13 is turned off; and the valve 8 is opened, while the valve 35 is closed. Then, as indicated by the solid-line arrows in FIG. 9, the refrigerant is compressed by the compressor 1 and then introduced into the indoor heat exchanger 3 in which heat exchange is carried out. The refrigerant which is discharged and is at a lower temperature flows into the bypass line 7. The refrigerant discharged from the bypass line 7 through the valve 8 and the decompression device 9 flows into the heat accumulator 2 in which heat exchange is carried out. The refrigerant heated by the heat accumulator 2 flows into the injection pipe **7*b* and is injected through the check valve 24 into the cylinder of the compressor 1**.

It follows therefore that the refrigerant which has flowed into the bypass line will not flow through the valve 35 into the outdoor heat exchanger 5 so that heat and pressure loss can be reduced to a minimum. (In the above described case, the outdoor fan 13 is turned off.) So far the decompression device 4 has been described as being closed, but when it is throttled by the superheat control (while the outdoor fan 13 is turned on), the refrigerant, whose pressure is decreased by the decompression device 4, is introduced into the outdoor heat exchanger 5 in such a state that the refrigerant can absorb heat.

In the outdoor heat exchanger 5, heat exchange is carried out, and the refrigerant which has absorbed heat is circulated to the suction port of the compressor 1. Almost all of the refrigerant which has undergone heat exchange in the indoor heat exchanger 3 flows into the bypass line 7, heated by discharged heat from the heat accumulating material in the heat accumulator 2 and flows into the injection pipe 7 so that it is recirculated into the compressor 1. A portion of the refrigerant is cooled when it passes through the decompression device 4, absorbs heat from the surrounding air in the outdoor heat exchanger 5 and then flows back into the compressor. Therefore the refrigerant has two evaporation temperatures because of the absorption of heat dissipated from the heat accumulator and the heat from the surrounding atmosphere. As a result, the heating capacity becomes the sum of the refrigerants having two different evaporation temperatures as described above, whereby it becomes higher.

When the heating by utilizing accumulated heat is continued, the temperature of the heat accumulating material drops. Then the valve 35 is opened so that the refrigerant flows into the bypass line 7. More particularly, the temperature inside the heat accumulator 2 detected by the temperature sensor 10 becomes below, for instance, 15° C.; the outdoor fan 13 is turned on; and the valve 35 is opened. Then the refrigerant which is discharged to flow into the bypass line 7 and then into the outdoor heat exchanger 5 through the valve 35. After the heat exchange in the outdoor heat exchanger 5, causing the refrigerant to absorb heat, the heated refrigerant is recirculated to the suction port of the compressor 1.

The switching between the mode for heating by utilizing accumulated heat and the heat-accumulation mode is made in response to the comparison of the temperature $T_{HC}$ detected by the temperature sensor 10 and a set point Tp which is set to, for instance, 10° C. in this embodiment as shown in the TABLE below.

| | Temperature of heat accumulator | |
|---|---|---|
| | Higher than Tp | Lower than Tp |
| Mode | Mode for utilizing accumulated heat | Heating and heat-accumulation |

p When the heating by utilizing accumulated heat is continued, the temperature of the heat accumulator vessel **2*a*** drops below, for instance Tp, the air conditioning equipment is automatically switched to the "heating and heat-accumulation mode" to be described below in (2)- 2 .

(2)- 2 Heating and Heat-Accumulation Mode:

In the case of the heating and heat-accumulation mode in which heat is accumulated while the heating is continued, the refrigerant compressed by the compressor 1 circulates through a loop consisting of the heat accumulator, the indoor heat exchanger 3, the decompression device 4, the outdoor heat exchanger 5 and the compressor 1. When the heating operation is continued in this manner, frost is deposited on the outdoor heat exchanger 5 so that the defrosting operation is needed.

The switching between the "heat-accumulation mode" and the "heating and heat-accumulation mode" can be automatically made in response to the result of the comparison of the room temperature $T_{IN}$ and a set point of an indoor thermostat Ts as shown in the TABLE below.

In the latter case, the air conditioning equipment is switched to the heat accumulation mode (1), but is switched to the heating and heat-accumulation mode when $Ts > T_{IN}$. When acceleration of the start-up operation is desired, the air conditioning equipment can be switched to the mode for heating by utilizing accumulated heat when the temperature of the heat accumulator vessel **2*a*** is higher than 10° C.

| Condition | $T_{IN} \geqq Ts$ | $T_{IN} < Ts$ |
|---|---|---|
| mode | heat accumulation | heating and heat accumulation |

Next the defrosting operation will be described.

(2)- 3 Defrosting Mode:

In the case of the mode for defrosting the outdoor heat exchanger, the defrosting operation is started when the temperature detected by the temperature sensor 16 disposed at the inlet on the side of heating of the outdoor heating temperature drops below a set point (for instance, −15° C.). Another condition for starting the defrosting operation is that a predetermined time interval (for instance, 40 minutes) has already elapsed after the preceding defrosting operation. When the temperature detected by the temperature sensor 16 rises in excess of a set point (for instance, 10° C.), the defrosting operation is interrupted and the mode for heating by utilizing accumulated heat is started.

The flowing path of the refrigerant in the case of the defrosting mode is similar to that in the case of the mode for heating by utilizing accumulated heat because the valve 8 is opened. That is, the refrigerant flows through a loop consisting of the compressor 1, the heat accumulator 2, the indoor heat exchanger 3, the valve 8, the decompression device 9, the outdoor heat exchanger 5 and the compressor 1, whereby heat accumulated in the heat accumulator 2 can be effectively used for defrosting.

Figure 10:
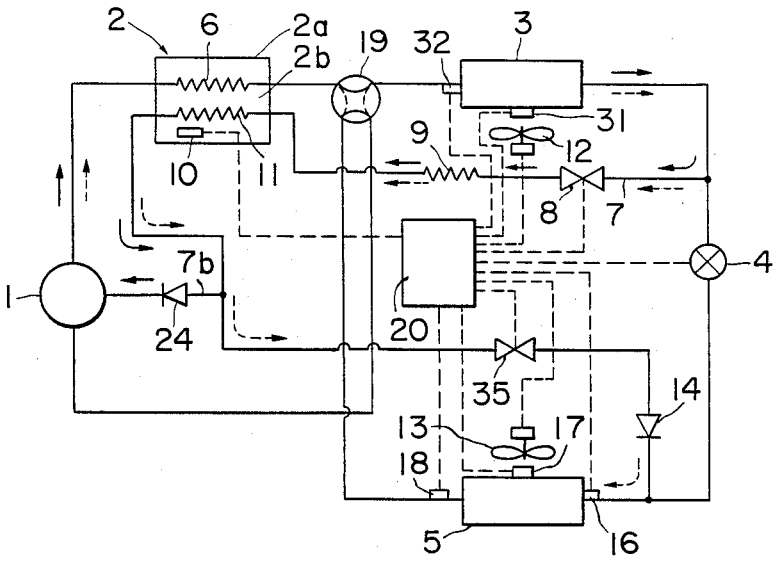
FIG. 10 is a schematic diagram similar to the refrigerating system shown in FIG. 9 but incorporating a four-port connection valve.

In the example shown in FIG. 9, the refrigerating system of an air conditioning equipment used exclusively for heating has been described, but it is to be understod that the present invention may be equally applied to a heat-pump type air conditioning equipment capable of heating and refrigerating or cooling as shown in FIG. 10.

That is, as in the cases of the examples shown in FIGS. 3 and 8, the temperature sensors 31 and 32 are disposed adjacent to the indoor heat exchanger 3; the check valve 14 is inserted into the bypass line 7; and the four-port connection valve 19 is interposed between the heat accumulator 2 and the indoor heat exchanger 3, whereby the refrigerating cycle can be carried out. In the example shown in FIG. 10, the modes except the refrigerating or cooling mode are substantially similar to those of the preceding examples so that only "the refrigerating or cooling mode" will be described.

| Mode | Indoor fan 12 | Outdoor fan 13 | Valve 8 . | Valve 35 | Decompression device 4 |
|---|---|---|---|---|---|
| Refrigeration | On | On | Closed | Closed | Superheat control |

In the refrigerating or cooling mode, the refrigerant compressed by the compressor 1 is circulated through a loop consisting of the heat accumulator 2, the four-port connection valve 19, the outdoor heat exchanger 5, the decompression device 4, the indoor heat exchanger and the compressor 1. During the refrigerating or cooling mode, heat is accumulated in the heat accumulator 2. The valve 8 has been described as being closed, but it is to be understood that it can be opened to return the refrigerant in the bypass line 7.

Next, referring to FIG. 11, a further preferred embodiment of the present invention will be described.

Figure 11:
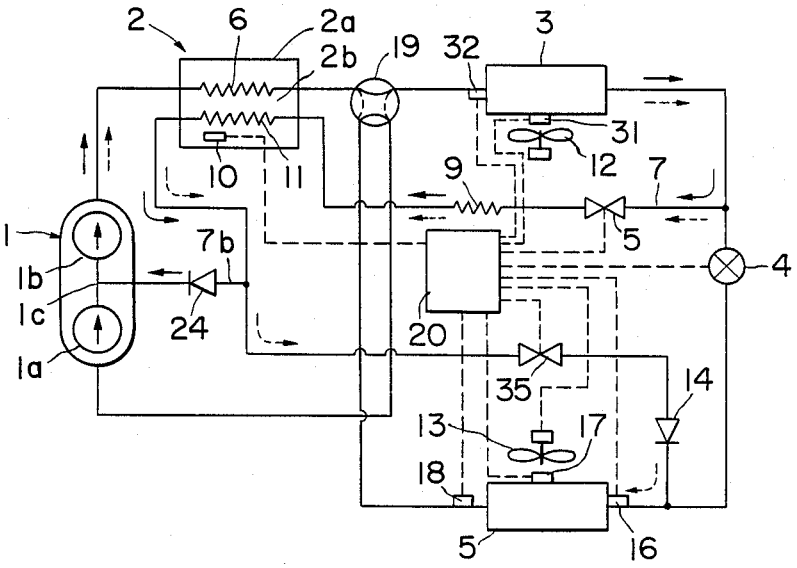
FIG. 11 is also a schematic diagram similar to FIG. 9 but incorporating a four-port connection valve and a two-stage compressor in the refrigerating system.

The example shown in FIG. 11 is substantially similar in organization to the example shown in FIG. 10 except in the type of the compressor. That is, in the case of the example shown in FIG. 11, a two-stage type compressor is used.

In the two-stage compressor 1 shown in FIG. 11, the two compression stages 1*a* and 1*b* are intercommunicated by a line 1*c*. That is, the two compressor stages 1*a* and 1*b* for compressing the refrigerant are disposed in the same case and the refrigerant introduced through the suction port of the compressor 1 into the compression mechanism is compressed in two stages by the compressor stages 1*a* and 1*b*. The branch pipe 7*b* branched from the bypass line 7 is communicated with the line 1*c* in the compression mechanism, and the refrigerant discharged from the indoor heat exchanger 3 and flowing in the bypass line 7 flows through this branch pipe 7*b* into the second compressor stage 1*b* in which the refrigerant is compressed and from which it is discharged.

The mode of operation of the example shown in FIG. 11 is substantially similar to that of the example shown in FIG. 10. The solid-line arrows indicate the flow of the refrigerant in the case of heating start-up, while the broken-line arrows indicate the flow of the refrigerant in the case of the defrosting mode.

What is claimed is:

1. A refrigerating system comprising:

a compressor;

a condenser communicating with a discharge port of the compressor;

an evaporator communicating a suction port of the compressor;

a first expansion means disposed in a line interconnecting the condenser and the evaporator;

a heat accumulator interposed between the discharge port of the compressor and the condenser;

a bypass line interconnecting an outlet port of the condenser and an inlet port of the evaporator through the heat accumulator, and bypassing the first expansion means; and a second expansion means disposed in the bypass line.

2. A refrigerating system as set forth in claim 1, further comprising temperature detection means disposed within said heat accumulator, an evaporator fan mounted on said evaporator and control means for controlling the operation of said evaporator fan in response to the output of said temperature detection means.

3. A refrigerating system as set forth in claim 1, wherein the heat accumulator, the condenser and the suction ports of the compressor and the evaporator are intercommunicated with each other through a four-port connection valve.

4. A refrigerating system as set forth in claim 1, wherein said first expansion means comprises an electrically driven expansion valve.

5. A refrigerating system as set forth in claim 1, wherein said first expansion means comprises an automatic temperature-responsive expansion valve and a valve is disposed on the upstream side of said automatic temperature-responsive valve.

6. A refrigerating system as set forth in claim 1, wherein a branch pipe is branched from said bypass line extended out of said heat accumulator and is communicated with the suction port of said compressor.

7. A refrigerating system as set forth in claim 6, further comprising temperature detection means disposed within the heat accumulator and a valve disposed in the branch pipe.

8. A refrigerating system as set forth in claim 6, wherein the heat accumulator, the condenser and the suction ports of the compressor and the evaporator are intercommunicated with each other through a four-port connection valve.

9. A refrigerating system as set forth in claim 1, wherein a branch pipe is branched from said bypass line extended out of the outlet side of said heat accumulator and is communicated with the compression mechanism in said compressor.

10. A refrigerating system as set forth in claim 9, wherein a valve which prevents flow of the refrigerant flowing in the bypass line from flowing into the evaporator is disposed in said bypass line.

11. A refrigerating system as set forth in claim 9, wherein the heat accumulator, the condenser and the suction ports of the compressor and the evaporator are intercommunicated with each other through a four-port connection valve.

12. A refrigerating system a set forth in claim 9, wherein said compressor is a two-stage type compressor.

13. A method of operating a refrigerant system, comprising the steps of:

heating a refrigerant to a high temperature by compressing it in a compressor to a high pressure;

storing a heat of the heated refrigerant in a heat accumulator by sending the heated refrigerant to the heat accumulator;

liquefying the refrigerant in a condenser;

heating the liquified refrigerant flowing through the heat accumulator by using the stored heat;

gasifying the heated refrigerant in an evaporator;

sending the gasified refrigerant to the compressor;

interconnecting a first expansion means in a line between the condenser and the evaporator; and interconnecting a bypass line between the condenser and the evaporator through the heat accumulator and bypassing the first expansion means, said bypass line including a second expansion means.

14. The method of claim 13, further comprising the steps of:

detecting the temperature of the heat accumulator by an associated temperature detection means; and controlling the operation of an evaporator fan in response to the output of the temperature detection means.

15. The method of claim 13 further comprising the steps of:

sending a portion of the heated refrigerant directly to a suction port of the compressor through a branch pipe;

gasifying the remaining portion of the heated refrigerant in the evaporator; and sending the gasified refrigerant to the compressor.

16. The method of claim 13, further comprising the steps of:

detecting the temperature of the heat accumulator by an associated temperature detection means; and controlling the operation of a valve in an associated branch pipe in response to the output of the temperature detection means.

17. The method of claim 16, further comprising the steps of:

injecting a portion of the heated refrigerant directly into the compressor through the branch pipe;

gasifying the remaining portion of the heated refrigerant in the evaporator; and sending the gasified refrigerant to a suction port of the compressor.

* * * * *